US005219066A

United States Patent [19]

Jameson

[11] Patent Number: 5,219,066

[45] Date of Patent: Jun. 15, 1993

[54] WALL MOUNTED ALARM SWITCH WITH ADJUSTABLE HEIGHT ACTUATOR

[76] Inventor: Kevin Jameson, 307 Dorset Ct., Doylestown, Pa. 18901

[21] Appl. No.: 833,492

[22] Filed: Feb. 10, 1992

[51] Int. Cl.[5] ..... H01H 21/80

[52] U.S. Cl. ..... 200/42.01; 200/43.16; 200/518; 200/331

[58] Field of Search ..... 200/42.01, 43.16, 43.19, 200/331, 332, 334, 518

[56] References Cited

U.S. PATENT DOCUMENTS

| | | | |
|---|---|---|---|
| 809,120 | 1/1906 | Levinson | 200/42.01 X |
| 2,221,992 | 11/1940 | Ojalvo | 200/42.01 |
| 2,665,340 | 1/1954 | Hammerstrand | 200/42.01 |
| 3,109,900 | 11/1963 | Van Hook | 200/43.19 |
| 3,755,642 | 8/1973 | Warner | 200/332 |
| 3,774,000 | 11/1973 | Beer | 200/332 |
| 3,821,529 | 6/1974 | Kallage, Jr. et al. | 200/332 X |

FOREIGN PATENT DOCUMENTS

| | | | |
|---|---|---|---|
| 2914783 | 1/1980 | Fed. Rep. of Germany | 200/331 |

*Primary Examiner*—Renee S. Luebke
*Attorney, Agent, or Firm*—Daniel E. Kramer

[57] ABSTRACT

A wall mounted alarm switch assembly intended to be positioned at the site of an existing electric circuit includes a remote mechanical actuating mechanism for the switch assembly. The actuating mechanism comprises dual side-by-side manual interfaces or knobs which are positioned at a location immediately below the position of the switch assembly. The manual interfaces are connected to the switch assembly by rigid members. The distance between the manual interfaces and the switch assembly is adjustable. The alarm switch is activated when both interfaces are moved, each in a direction away from the other, thereby separating the two interfaces.

15 Claims, 5 Drawing Sheets

WALL MOUNTED ALARM SWITCH WITH ADJUSTABLE HEIGHT ACTUATOR

FIELD OF THE INVENTION

The present invention relates to a wall mounted alarm switch assembly and more particularly to a wall mounted alarm switch assembly having a mechanical actuator for the switch assembly which is positioned at a different height from the switch assembly itself. The invention relates further to such a wall mounted switch assembly having a mechanical actuator whose distance from the switch assembly itself is adjustable. The invention relates further to such a switch assembly employing two adjacent activator interfaces where the alarm can be activated only by the action of moving apart the adjacent activator interfaces.

BACKGROUND OF THE INVENTION

Building codes, sparked by federal requirements, have recently been changed to establish new requirements for accessibility of manual stations or activators for fire alarms. The early codes and requirements will henceforth be referred to as "early" or "old". The current changed codes and new requirements will henceforth be referred to as "new". Building codes for public buildings such as schools, department stores and libraries, among many others, have long required fire alarm switches or manual stations to be positioned where they can be readily accessed by occupants. These old manual stations were uniformly positioned at elevations above the floor which were sufficiently great to minimize access by children. Typical elevations for the old manual stations ranged from 50 inches to 62 inches (1.27 m to 1.58 m). Further, the old manual stations were designed to minimize false alarms by requiring some strength and or manual dexterity for actuation. Many old manual stations enclosed an alarm switch behind a plate of glass and required a person desiring to effectuate actuation of the manual station and thereby an activation of the alarm, to break the glass, generally with a small hammer hanging on a chain positioned nearby for the purpose. The alarm switch protected by the glass could then be accessed and actuated.

The new federal requirements were sparked by at least two-fold concerns: first, that people confined to wheelchairs would not be able to reach manual stations positioned high above the floor under the old codes; and second, that people not in wheelchairs but either elderly or having severe physical handicaps, would not have the mechanical strength or dexterity to break a glass window or would be intimidated by the need for such violent action and for any of those reasons fail to initiate an alarm when such action was clearly indicated.

The new federal requirements therefore mandated that manual stations for fire alarms be positioned with their centerline locations at an elevation no higher than 48 inches (1.22 m) above the floor and that no unusual strength or manual dexterity be required for actuating the tripper.

Owners of existing buildings, having manual stations installed at the old range of heights, are now required to install new manual stations which meet the new requirements for strength and dexterity at the lower elevations required by the new codes. Not only are the building owners exposed to the expense of purchasing new manual stations to meet the new requirements, but the owners must also pay for installing a new junction box at the newly required elevation, extending the wiring to the new junction box and patching or otherwise closing or covering the old junction box in an approved and sightly manner. In a union environment these steps might require services by electricians, lathers, plasterers and painters.

Through the use of manual stations of the present invention, all of the requirements of the new regulations and codes can readily be met simply by removing the old manual station and installing the new manual station, made in accord with the teaching of the present invention, in its place.

Further, the manual station of the present invention, though easily actuated by occupants of wheelchairs or by the disabled, avoids nuisance or accidental trips by requiring a special actuating motion which cannot be accidently generated. Further, the manual station of the present invention includes means for electrically alerting a remote supervisor or a supervisory network, in a trouble mode if the manual station is incorrectly or accidentally actuated and in an alarm mode if the manual station is deliberately actuated. It also simultaneously provides different mechanical indications which are easily discernable both at the manual station itself or at a distance, of either an accidental or nuisance trip on one hand or of a deliberate and effective actuation on the other.

The present invention teaches a manual station having a switch assembly intended to be mounted directly in place of the old manual station at the same elevation and on the same junction box on which the old manual station was mounted. The switch assembly includes mechanical arms extending downward and terminating in a pair of adjacent, ergonomically shaped, manual interfaces, each independently movable in a arc centered at the switch assembly. The mechanical arms and the interfaces have provisions to allow the distance between the interfaces and the switch assembly and thereby the elevation of the interfaces above the floor, to be adjusted and thereafter fixed to conform to the new requirements of the federal regulations and the conforming local and state codes.

By the use of manual stations designed and constructed according to the teaching of the present invention, conformance to the new regulations and codes can readily be achieved without the need for new wiring and without the need for cutting-in new electrical boxes and without the need for removing the old electrical boxes and patching the walls where they resided.

By the use of the present invention all the requirements of the new federal regulations can be met without costly utilization of multiple trades. Further advantages will be described and will be evident in the course of the detailed description of the preferred embodiment and other related embodiments.

SUMMARY OF THE INVENTION

Briefly stated the present invention comprises remote means for affecting an electric circuit located at a first position on a plane. The remote means comprises a base which is located at the first position. There are control means, for affecting the circuit, positioned in operative relation to the base. Manual interface means are located at a second position on the plane for actuating the control means. Mechanical means are provided for connecting the manual interface means with the control means. Means are also provided for adjusting the distance between the manual interface means and the base.

Further, the control means is capable of activation in a first mode and a second mode. The control means is activated in a first mode by interface element movements selected from the group consisting of: moving only one element away from the other, leaving the other element stationary, and moving both elements together in the same direction. The control means is activated in the second mode by moving both of the adjacent elements, each in a direction away from the other.

BRIEF DESCRIPTION OF THE DRAWINGS

The foregoing summary, as well as the following description of preferred embodiments of the invention, will be better understood when read in conjunction with the appended drawings. For the purpose of illustrating the invention, there is shown in the drawings embodiments which are presently preferred. It should be understood, however, that the invention is not limited to the specific instrumentalities or to the precise arrangement of elements disclosed. In the drawings.

DETAILED DESCRIPTION OF THE INVENTION

Figure 1:
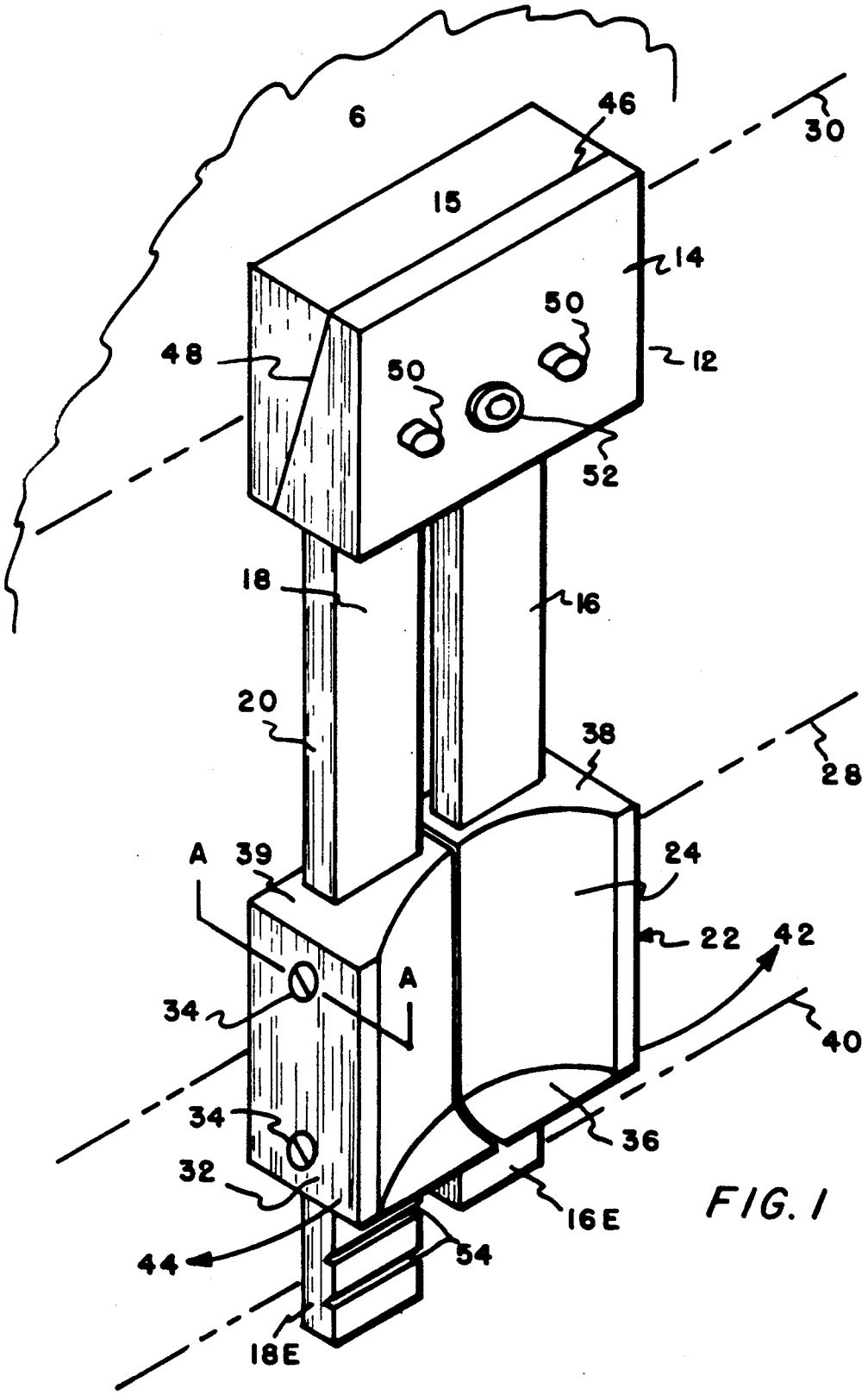
FIG. 1 is a view in perspective of an embodiment of the present invention including dual adjacent actuating interfaces and rods depending from a switch-containing housing.

Referring now to the drawings, Wherein like references are used to indicate like elements throughout, there is shown in FIG. 1 an overall view of a preferred embodiment of the present invention in which protective enclosure 12 is mounted on wall 6 and encloses switch mechanisms and pivots disclosed herein. These mechanisms will be described in greater detail in connection with discussion of the applicable figures.

In FIG. 1, screw 52 provides a mechanical closure, thereby ensuring that cover 14 of the protective enclosure 12 cannot readily be opened without tools. In other embodiments of the invention, a key-type interface for screw 52 is provided to prevent unauthorized access.

Figure 2:
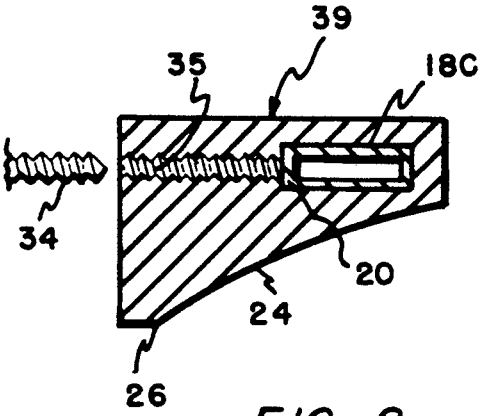
FIG. 2 is a plan view in cross-section of a actuating interface including one embodiment of means for fixing the position of the interface on a rod.

Rods 16 and 18 depend from the internal mechanisms to be disclosed. Dual activator interfaces 22, comprising right hand interface 38 and left hand interface 39, are slidably mounted on two mechanical arms comprising a right hand rod 16 and left hand rod 18, respectively. Each activator interface is arcuately moveable on its respective rod. Locking set screws 34, shown in position in FIG. 1 and in an exploded cross-sectional view in FIG. 2, are employed to engage side 20 of rod 18 and the corresponding side of rod 16 and thereby fix the individual activator interfaces into the positions desired, along the length of rods 16 and 18. The exact position of the activator interfaces along rods 16 and 18 depends on the height above the floor of the original conduit or junction box, not shown, within which are located the control circuit wires and on which the original alarm box was mounted.

After the height above the floor of the original alarm box is ascertained, the position of the manual activator interfaces 22 along rods 16 and 18 can be determined with certainty for the purpose of assuring that the activator interfaces 22 will be positioned at a height above the floor which is in accord with federal and local building and safety codes, statutes and regulations, after the base and its protective enclosure 12 is mounted on the existing junction box and wired to the existing electric control circuit positioned within the original junction box.

Figure 3:
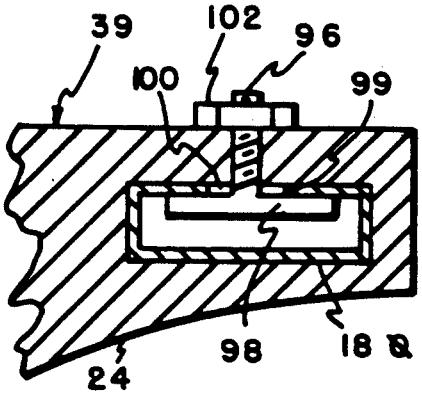
FIG. 3 is a plan view in crossection of another embodiment of an activating interface and rod.

FIG. 2 shows a cross-sectional view of the left hand interface 39 showing a threaded hole 35 for locking screw 34. The screw 34, when set into position bears against side 20 of rod 18. Rod 18 here has a completely closed construction, as a rectangular tube, and therefore is designated as 18-C. By contrast, in FIG. 3, rod 18 has an open construction and there is designated as 18-O. In FIG. 3 the interface 39 is locked in position to the rod 18-O by lock-screw 96 which has a large head positioned within the open rod. Nut 102 serves to clamp the interface to the rod at any desired position on the rod through the medium of the slot 100 running the length of the rod 18-O.

After the manual activator interfaces 22 are locked into the desired position on rods 16 and 18, there is likely to be excess rod length 16E and 18E (shown in FIG. 1), projecting beyond the activator interfaces 22. Although these projections can be readily sawed off, to minimize installation time, rods 16, 18 are provided with notches 54 to facilitate the breaking off excess rod lengths 16E, 18E which project below and beyond the activator interfaces 22 after the interfaces have been locked into the desired position along rods 16, 18.

An important feature of this embodiment of the present invention is the requirement that the alarm be effectuated only by deliberately pulling or otherwise moving apart and physically separating the two activator interfaces. To facilitate the effectuation of the alarm, the interfaces 22 are ergonomically shaped. That is, they are shaped to facilitate manual usage by an individual. Referring again to FIG. 1, each interface has an interior front facing surface 24 formed by the intersection of a cylinder with a portion of the front of the interface. The two front facing concave surfaces 24 allow even a handicapped person to effectuate the alarm process by pulling apart the two interfaces. A slanted lower shelf 36 is planar in this embodiment but is curved in other embodiments of this portion of the invention. Shelf 36 facilitates effectuation of the alarm process by preventing the user's fingers or other body members or a hand-held tool, such as a cane, from slipping off the interfaces during the period she is initiating the alarm.

Figure 4:
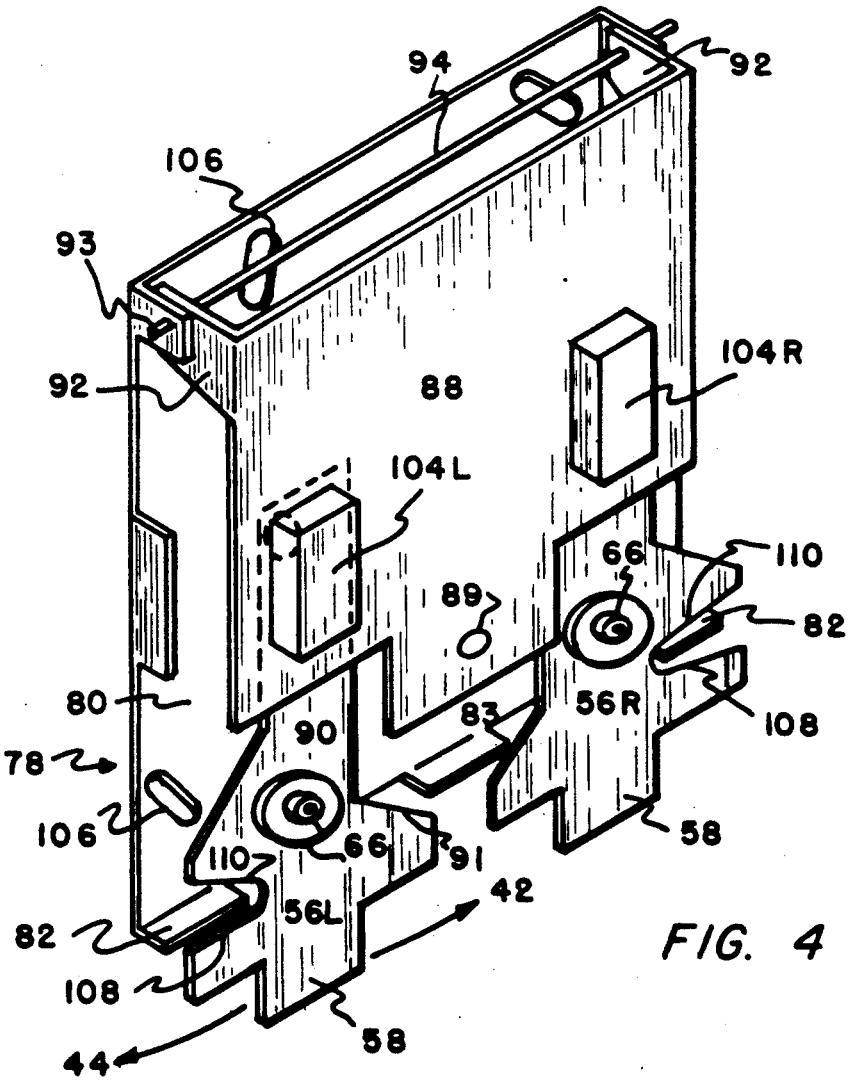
FIG. 4 shows, in an isometric view, a complete switch assembly such as resides within the switch housing of FIG. 1, also showing two switches mounted on a pivoting platen.
Figure 6:
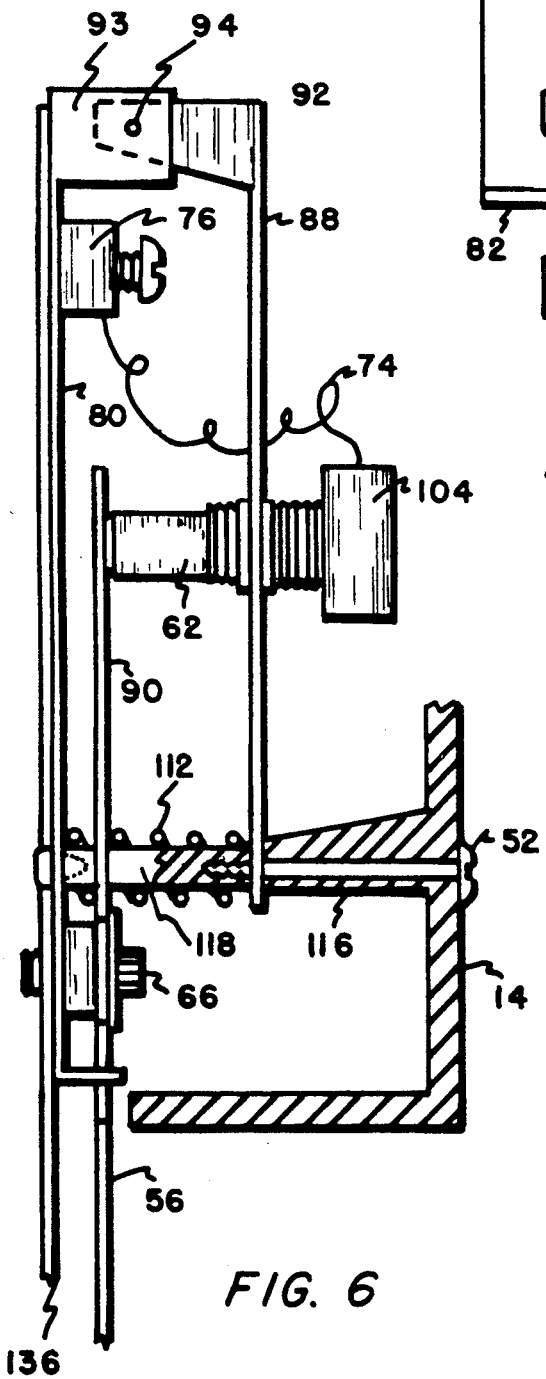
FIG. 6 is a side elevation in partial cross-section of the switch assembly including a base, a pivoting switch plate and an insulating cover.

FIG. 4 is an isometric view of a preferred embodiment of the switch assembly of present invention in which the construction of the mechanism is exhibited. FIG. 6 is a side elevation of the same embodiment including a portion of the protective enclosure in partial cross-section. Referring to both figures, base 80, formed of sheet steel in this embodiment, has mounting holes 106 positioned in each corner. Mounting holes 106 are elongated and are positioned with their long axes perpendicular to a radius drawn from the center of the base 80 to each hole 106. This mounting hole construction permits the base 80 to be rotated slightly after holes are drilled in the wall and screws installed, to permit the base 80 to be rotated to a precisely vertical position just before the screws are finally tightened.

A pair of pivot tabs 93 are fixed to and positioned at the top of base 80. The tabs 93 are traversed by hinge pin 94. Platen 88 is pivoted on hinge pin 94 by way of tabs 92 formed in platen 88. Switches 104L and 104R are mounted on platen 88, as shown in detail in FIG. 6. The L and R suffixes of the switches denote the position of each switch with respect to the left hand and right hand pivoted descending members 56L and 56R.

It is a feature of this embodiment of the present invention, that while the activator interfaces can be affected both by intended and by unintended motion, that only an intended motion of both of the activation interfaces sends an alarm signal to the supervisory center. An unintended motion of the activation interfaces also sends a signal, but a signal of a different kind, called here a trouble signal, not an alarm, to the supervisory center. The most likely unintended motion is one which pulls or pushes both interfaces in the same direction. A less likely unintended motion is one that pulls one interface away from the other leaving the first stationary.

By contrast, an intended motion, being that motion which deliberately pulls apart the two interfaces, immediately causes an alarm signal to be sent to the supervisory center.

It is also a feature of this embodiment of the present invention that any motion which causes any signal to be sent to the supervisory center will mechanically lock the device in a visibly tripped condition so that a service person or a fire fighter can instantly visually recognize which station was actuated to send the trouble or the alarm signal, and what type of signal was sent.

A principle of operation of this embodiment of the invention is that an unintended motion of the interfaces actuates only one of the two switches 104 included in the apparatus, while an intended motion of the activation interfaces actuates both switches, 104L and 104R. In one embodiment of the invention the two switches, which are open in the unactuated condition, are series connected. Each switch is bridged by a known resistance. A trouble signal is sent when either switch is closed, thereby reducing the resistance in the circuit to the value across the other open switch. An alarm signal is sent when both switches are closed, thereby reducing the resistance in the circuit to the line resistance only, or effectively to zero. A resistance detecting and discriminating device is programmed to take the action desired on the occurrence of each event.

In another embodiment of the present invention, switches 104 are of the single pole double throw type. These are connected by a fixed resistance, R, so that in the normal condition the monitoring circuit sees the value of the resistance R. In the trouble mode the monitoring circuit sees an open circuit or infinite resistance, and in the alarm mode the monitoring circuit sees a short circuit, or zero resistance.

Referring again to FIGS. 4 and 6, platen 88 is held in a position substantially parallel to base 80 along with cover 14 of the protective enclosure 12, by retaining screw 52 which engages stop pin 118, affixed to base 80. Bias spring 112 acts to force platen 88 away from base 80 when the retaining screw is removed.

When the platen 88 is held in the operating or closed position by retaining screw 52, the plungers 62 of switches 104 are pressed against and engage the upper or lever ends 90 of the descending members 56, or in other embodiments, of rods 16 or 18 where the rods and levers are integral. Should the platen 88 be released by unscrewing cover screw 52, both switches 104L and 104R will be released and their circuits actuated, immediately sending an alarm signal to the supervising center.

Figure 5:
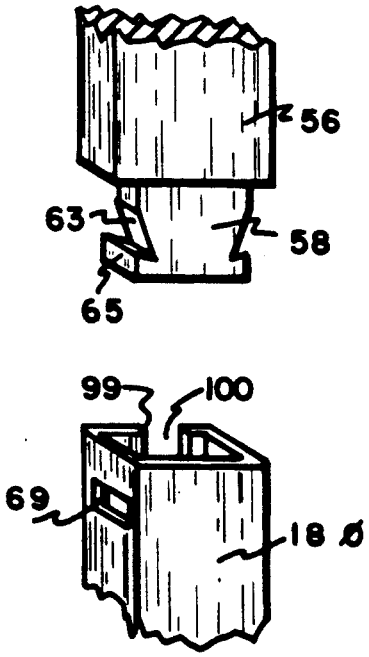
FIG. 5 shows a detail of a construction allowing the rods to be field assembled to the switch assembly.

Each pivoted descending member 56 is intended to have affixed to it a rod 16, 18 on which is mounted an interface 22. A detail of one method of mounting the rods to the descending members is illustrated in FIG. 5. There, the tongue 58 of the descending member 56 has a relieved portion or notch 63 which generates a relatively raised boss 65. A slot 69 is provided in rod 18 into which boss 65 securely fits, thereby locking rod 18 to tab 58. By this construction, it is possible for the rods to be manufactured in a variety of lengths, thereby allowing a contractor to select the length desired to meet the installation requirements without the need for cutting a rod. In the alternative, this construction allows the rods to be shipped unattached to the switch mechanism, reducing the possibility of damage occurring to the assembly during the shipping process.

In other embodiments of the present invention, the rods 16, 18 and the descending members 56 and the upper ends 90 are integral and formed of one piece of material or of several pieces and permanently fastened together at the time of manufacture.

Figure 7:
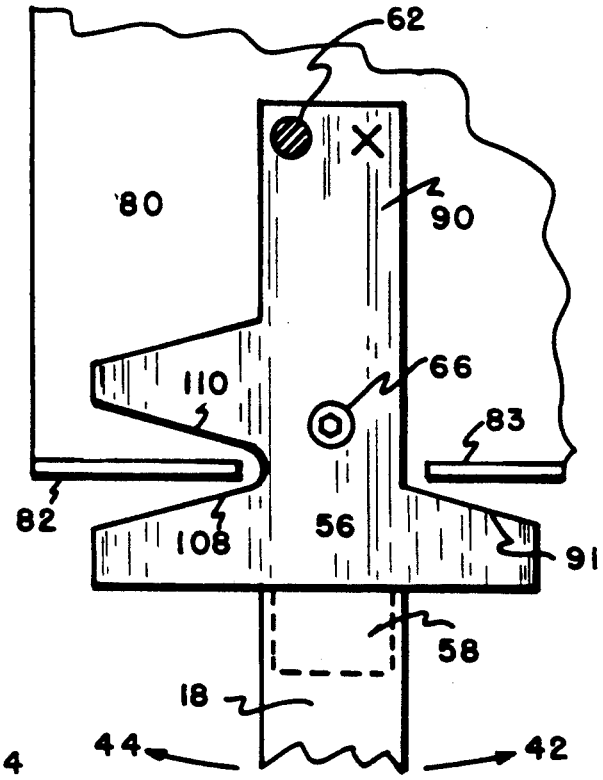
FIG. 7 is a partial cross-section of the structure of FIG. 6 taken through the switch plunger and shows the pivoting upper portion of an actuating rod.

Examining now the functions of the switches 104 under the various conditions of intended and unintended operation, reference to FIGS. 1, 4 and 7 shows movements 42 and 44 of activator interfaces 22. FIG. 7 shows the upper, pivoting portion, which is shown connected to rod 18 in FIGS. 1, 4 and 5. Attempted movement of the interface 39, mounted on left hand rod 18, in such a way as to cause motion of rod 18 in direction 42 will have no effect on the switch 104L since shoulders 91 and 110 of the descending member 56 will abut lower left and center flanges 82 and 83 of base 80 preventing switch plunger 62 from moving beyond point x on the lever end 90. In an analogous way, attempted movement of a right-hand interface 38 in a direction 44 would also have no effect on right-hand switch 104R.

Figure 8:
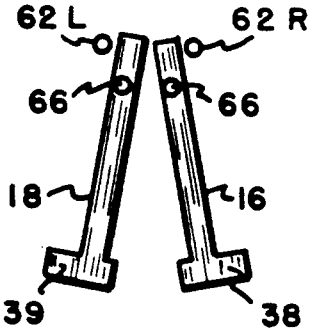
FIGS. 8, 9 and 10 respectively show an alarm condition and two trouble conditions of the rods with respect to their associated switches.

FIG. 8 shows the relative position of the rods and switches in an alarm condition, both activation interfaces having been moved away from each other and both plungers 62 having been released from their respective levers 90 into a tripped or switch closed condition. Once in the tripped condition, the plungers 62 prevent the levers 90 from being restored to their original vertical rest positions until the cover of the switch assembly has been opened by an authorized person and platen 88 lifted, thereby ensuring that the visual evidence of a tripped condition remains until corrected by an authorized person.

Figure 9:
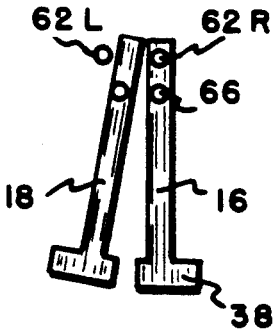
Figure 10:
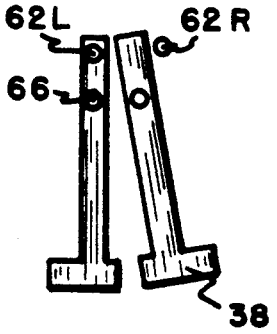

FIGS. 9 and 10 show the relative positions of the rods in opposite trouble signal conditions. In FIG. 9 the left hand interface 18 has been moved to the left of its rest position, the right hand interface having been left stationary. In FIG. 10 the right hand interface 16 has been moved to the right of its rest position, the left hand interface having been left stationary. It should be noted that an effort to move the left hand interface to the left by attempting to move the right hand interface to the left will fail because the mechanical stops provided by shoulders 91 and 110 of FIG. 4 limit the leftward motion of the right hand interface. The same restriction applies to attempted motion of both interfaces in the right hand direction. In either trouble signal condition, only one lever has moved to allow the plunger 62 of its associated switch 104 to drop into a switch closed condition. This lever remains mechanically locked in a trouble signal condition until remedied by an authorized person as described above.

Figure 11:
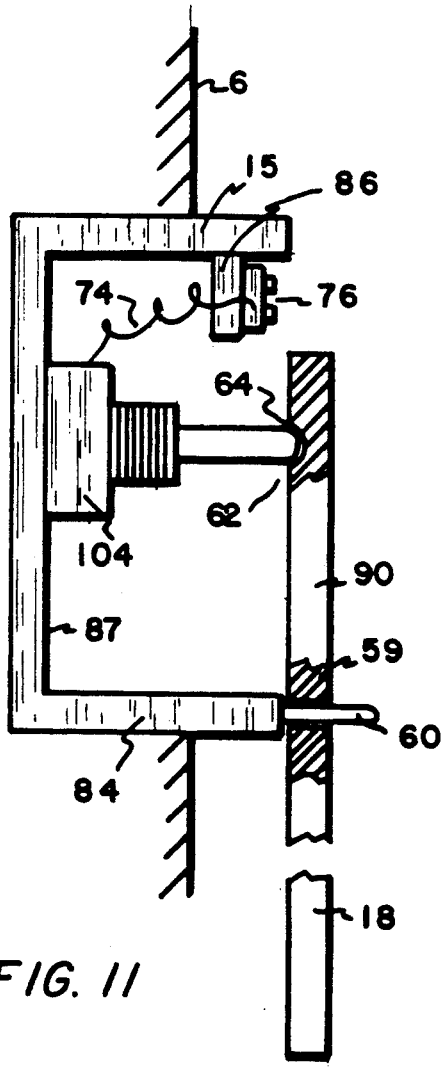
FIG. 11 is a side elevation in partial cross-section of an embodiment of the present invention where the switches are mounted on the base.

FIG. 11 shows another embodiment of the present invention where the switches 104 are positioned on a base 87 along with electrical connection terminals 76. Pivot 60, securely mounted to base 87, is provided onto which rods 16, 18 can be installed after the base has been fastened to the wall at the location of the pre-existing electric control circuit. A cover, not shown, is intended to retain the rods in their operating positions until service or reset is necessary.

Figure 12:
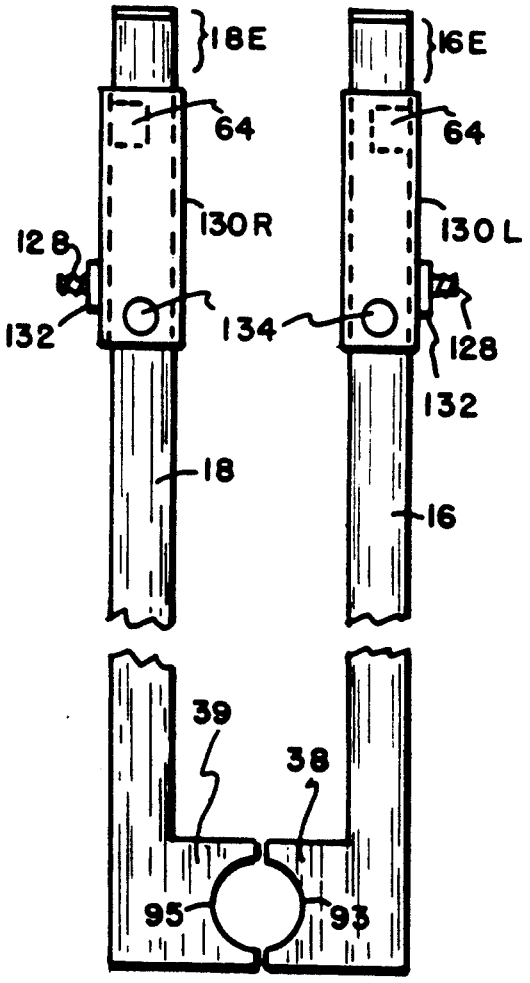
FIG. 12 shows a front elevation of an embodiment of the present invention where the distance between the actuating interfaces and the base is adjusted by sliding the rods through pivoting sleeves mounted on the base.

FIG. 12 demonstrates a construction in which the activation interfaces 38, 39 are fixed to rods 16, 18. The adjustment of the distance between the interfaces and the switch base is made variable through the provision of sleeves 130L and 130R through which the rods 16 and 18 can slide freely. Once the rods 16 and 18 have been positioned so that the height of their interfaces above the floor is in accord with the applicable statutes, regulations or codes, the position of the rods is fixed with respect to the sleeves by set screws 128 and lock nuts 132. Excess rod length 16E and 18E, projecting above sleeves 130, are either sawed off or broken off via application of notches or cuts 54 shown in FIG. 1.

Figure 13:
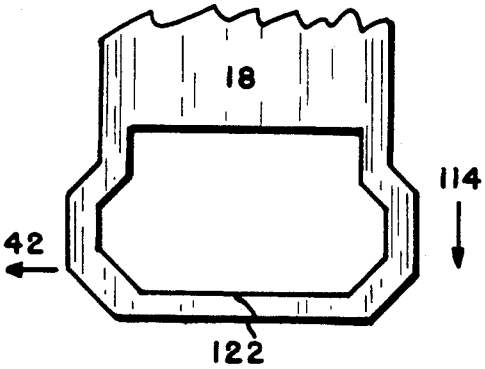
FIG. 13 is a side elevation of another embodiment of the present invention where the switch actuation requires either a sideways or a downward motion of the actuation interface.

FIG. 13 demonstrates another embodiment of the present invention in which the activation interface 122 may be pulled down as well as to one side, to release plunger 62 and thereby activate the switch 104 associated with the plunger. Spring 170, anchored to base 80 by pin 72, is hooked into hole 71 in lever 90 and serves to bias the lever 90, rod 18 and the activator interface in an upward position until a downward pull on activator interface 122 moves the upper edge Z of lever 90 downward sufficiently to release plunger 62 of associated switch 104. Embodiments employing only one switch have only one actuation mode.

Alternate embodiments of the invention employ a flexible element such as a wire, a cable or a chain instead of a rigid rod to achieve actuation of switch 104 by a downward motion of the activator interface 122. Other embodiments of the present invention employ two interfaces and two switches, thereby establishing the operational requirement that both interfaces be pulled down to actuate the alarm. Still other embodiments of the pull-down form of the present invention, generally shown in FIG. 13, incorporate an adjustable length feature as disclosed in FIGS. 1, 2, 3 and 12 and elsewhere in the drawings and specification of this patent.

Figure 14:
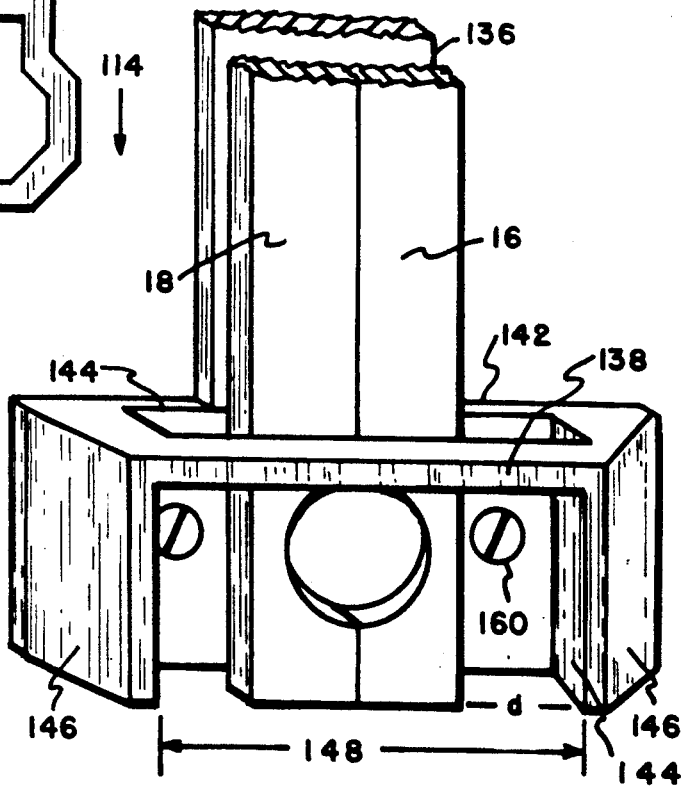
FIG. 14 is a perspective view of the activation interfaces positioned in a protective fixture or restraint to avoid accidental actuation.

In high traffic or aggressive environments, frequent trouble signals may be expected, caused by violent movement in one or another direction of an interface. In order to control these quasi-accidental activations, the structure of FIG. 14 is employed. In FIG. 14 a restraint or high-traffic-inhibitor 142 is employed which deflects aggressive external motion away from the interfaces by the sloped deflecting planes 146. The substantially perpendicular internal surfaces 144 are spaced sufficiently far from the rest position of the interfaces that movement of the interfaces to and against the internal surfaces 144 is sufficient to actuate one or both switches 104, thereby effectuating either a trouble or an alarm mode. In an alternate embodiment of the invention shown in FIG. 14, restraint 142 is secured in position adjacent the lower end of activator interface 16, 18 by vertical support 136. Vertical support 136 in turn is securely fastened to wall 6 (FIG. 1), directly or indirectly, at the position of base plate 80, by the same or similiar means (FIG. 4, 6) employed to fasten base plate 80 to wall 6. The use of vertical support 136 allows restraint 142 to be securely positioned without the need for drilling additional holes in a valuable or decorative wall 6. Where holes may be freely drilled in wall 6, another embodiment of the present invention is disclosed, characterized by the use of screws 160 to mount restraint 142 to wall 6 and the omission of vertical support 136. Front guard 138 is supplied on restraint 142 to protect against an inadvertent downward thrust on interface 16, 18 when the two are fused into a single interface capable of actuation by a downward pull, in a direction away from the base, as disclosed in FIG. 13. Front guard 138 may be omitted when the structures and actuation modes, disclosed in FIGS. 1, 4, 8, 9, 10 and 15, are employed.

Figure 15:
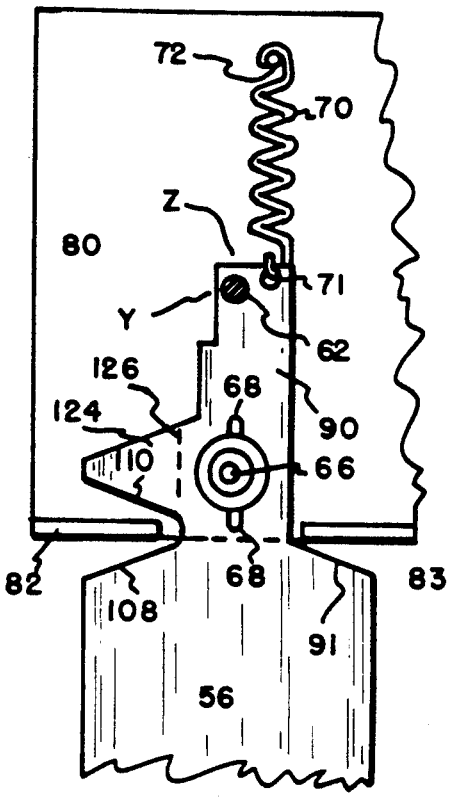
FIG. 15 is a front elevation of an single switch embodiment of the present invention.
Figure 15:
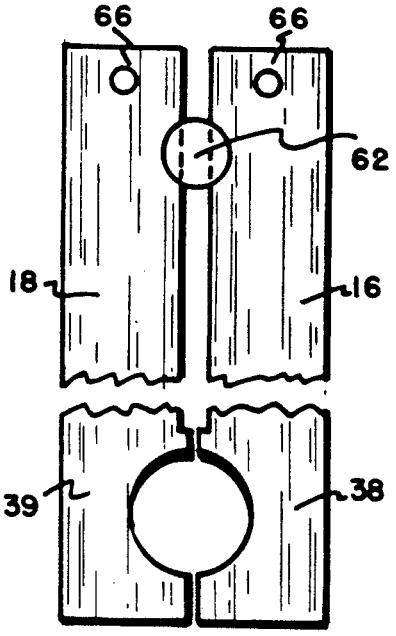

In FIG. 15, only one switch having plunger 62 is employed. The plunger is positioned to rest on the inner edges of the rods 16 and 18. When only one rod is moved either to the right or to the left from its rest position, by manual movement of its associated activation interface, the plunger 62 is not released but continues to rest on one rod or the other. For example, if rod 16 is moved to the right by manual movement of its activation interface 38, and rod 18 is left stationary, plunger 62 continues to rest on rod 18 and therefore the plunger is not released and the switch 104 (not shown) associated with plunger 62 remains unactuated. If rod 16 is moved to the left, plunger 62 will reside fully on rod 16 and will not be released. However, if the activating interfaces 38 and 39 are moved away from each other, the rods 18 and 16 will be moved apart and plunger 62 will fall into the gap between them, thereby actuating the switch associated with the plunger 62.

From the foregoing description, it can be seen that the present invention comprises an improved wall mounted switch with novel and unobvious means for remote mechanical actuation. It will be appreciated by those skilled in the related arts that changes could be made to the above-described embodiments without departing from the broad inventive concepts embodied therein. It is understood, therefore, that this invention is not limited to the particular embodiment disclosed, but is intended to cover all modifications which are within the scope and spirit of the invention as defined by the following claims.

I claim:

1. Remote means for affecting an electric circuit, said circuit being located at a first position on a plane, the remote affecting means comprising: a base located at the first position, control means for affecting the circuit, said control means being positioned in operative relation to the base, two adjacent, independently arcuately movable manual interface means located at a second position on the plane for actuating the control means, substantially rigid mechanical means for separately connecting each manual interface means with a control means, and means for adjusting and fixing the distance between each manual interface means and the base.

2. Remote affecting means as recited in claim 1 where the control means comprises a single switch means for activation by the simultaneous motion of both interface means, each in a direction away from the other but not for activation by simultaneous motion of both interface means in the same direction or by motion of one interface means away from the other, leaving the other interface means stationary.

3. Remote affecting means as recited in claim 1 where each interface means has an ergonomic shape comprising a block having a height, a depth and a width, and top, bottom, back, front, inner side and outer side surfaces, where the back surface has a rectangular shape having inner and outer vertical edges spaced apart by the width, the back surface being positioned substantially parallel to the plane; a rectangular inner side having a back edge congruent with the inner edge of the back, and having a front edge, the inner side being perpendicular to the back; and a rectangular outer side having a back edge congruent with the outer edge of the back and having a front edge, the outer side being perpendicular to the back, a top and a bottom parallel to each other spaced apart by the height; and a front surface formed by the intersection of a cylinder having a vertical axis and intersecting the front and the inner side.

4. Remote affecting means as recited in claim 3 further providing that each interface means further includes a lower planar portion intersecting the cylindrical surface and the bottom.

5. Remote affecting means as described in claim 1, further providing that the control means comprises two independent switches, each positioned to respond to the motion of an individual interface means, one switch only being activated by interface means movements selected from the group consisting of: movement of one interface means away from the other, the other interface means remaining stationary, and movement of both interface means together in the same direction; and both switches being activated by movement of both of the adjacent interface means, each in a direction away from the other.

6. Remote affecting means as recited in claim 5 where the control means are mounted on the base.

7. Remote affecting means as recited in claim 5, further including a platen pivotingly mounted with respect to the base, and further providing that the control means are mounted on the platen.

8. Remote affecting means as recited in claim 5 where the arcuately moveable manual interface means are slidably mounted on the mechanical connecting means and the adjusting means comprises means for securing the slidable interface means on the connecting means thereby preventing further sliding motion.

9. Remote affecting means as recited in claim 8, further providing that the mechanical connecting means includes an end adjacent to the manual interface means and further providing means for facilitating breaking off the end.

10. Remote affecting means as recited in claim 5 further including deflecting means, positioned to partially enclose the movable manual interface means, for preventing inadvertent motion of the manual interface means.

11. Remote affecting means as recited in claim 10, further including means for supporting the deflecting means from the base location.

12. Remote affecting means as recited in claim 5 where the arcuately moveable interface means are integral with the mechanical connecting means.

13. Remote affecting means as recited in claim 12 where the means for adjusting the distance between a manual interface means and the base comprises base mounted rotatable means slidably engaging a mechanical connecting means and means for securing the connecting means to the rotatable means, thereby preventing further sliding motion of the mechanical connecting means, whereby the distance between the manual interface means and the base is fixed.

14. Remote affecting means as recited in claim 13 further providing that the mechanical connecting means includes an end adjacent the rotatable means and further providing means for facilitating breaking off the end.

15. Means for manually actuating at a first position on a plane an electric circuit positioned at a second position on the plane, the actuating means comprising: base means for mounting on the plane at the second position, switch means for connection to and actuation of the electric circuit, said switch means operatively positioned with respect to the base means, two manual interface means positioned off the base, side-by-side on the plane, at the first position for manual motion to activate the switch means; mechanical means for transmitting motion from the manual interface means to the switch means, pivot means for securing and allowing rotation of the mechanical means and means for actuating the electric circuit only when the interface means are both manually moved, each in a direction away from the other.

* * * * *